US009022496B2

(12) United States Patent
Armstrong et al.

(10) Patent No.: US 9,022,496 B2
(45) **Date of Patent: *May 5, 2015**

(54) VERTICALLY ADJUSTABLE SHELF SUPPORT ASSEMBLY FOR AN APPLIANCE

(71) Applicant: General Electric Company, Schenectady, NY (US)

(72) Inventors: James Lee Armstrong, Louisville, KY (US); Darren Allen Turner, Louisville, KY (US)

(73) Assignee: General Electric Company, Schenectady, NY (US)

( * ) Notice: Subject to any disclaimer, the term of this patent is extended or adjusted under 35 U.S.C. 154(b) by 22 days.

This patent is subject to a terminal disclaimer.

(21) Appl. No.: 13/847,701

(22) Filed: Mar. 20, 2013

(65) Prior Publication Data

US 2014/0285078 A1 Sep. 25, 2014

(51) Int. Cl.

| | |
|---|---|
| ***A47B 81/00*** | (2006.01) |
| ***F24C 15/16*** | (2006.01) |
| *A47B 88/00* | (2006.01) |

(52) U.S. Cl.

CPC ..... *F24C 15/16* (2013.01); *A47B 2088/0081* (2013.01); *A47B 2210/17* (2013.01)

(58) Field of Classification Search

CPC ..... F24C 15/16; F24C 15/168; A47B 21/02; A21B 3/155; A47L 15/504; A47L 15/506

USPC ..... 211/153, 90.03, 90.02, 96, 168, 169.1; 312/311, 330.1, 410, 351, 333, 334.47, 312/319.2, 302, 303, 319.3, 325, 332.1, 312/228.1; 126/337 R, 332, 337 A, 338, 339; 108/94, 95, 102

See application file for complete search history.

(56) References Cited

U.S. PATENT DOCUMENTS

| | | | | |
|---|---|---|---|---|
| 2,106,506 | A * | 1/1938 | Pletcher et al. | 126/41 E |
| 2,170,098 | A * | 8/1939 | Stephenson | 108/136 |
| 2,265,421 | A * | 12/1941 | Donnelly | 99/443 R |
| 2,477,305 | A * | 7/1949 | Leighton | 126/41 E |
| 2,486,564 | A * | 11/1949 | Kamin | 126/41 E |
| 2,598,266 | A * | 5/1952 | Kamin et al. | 126/334 |
| 2,804,068 | A * | 8/1957 | Miller et al. | 126/337 R |
| 2,834,334 | A * | 5/1958 | Bill | 126/41 E |
| 4,278,032 | A * | 7/1981 | Kritske | 108/6 |
| 5,447,146 | A * | 9/1995 | Nickerson | 126/339 |
| 6,789,861 | B1 * | 9/2004 | Dobberstein | 312/330.1 |
| 8,047,199 | B2 | 11/2011 | Le et al. | |
| 8,490,801 | B2 * | 7/2013 | Smith et al. | 211/153 |
| 8,733,862 | B1 * | 5/2014 | Armstrong et al. | 312/319.3 |
| 2008/0237166 | A1 * | 10/2008 | Williams et al. | 211/169.1 |
| 2010/0018517 | A1 * | 1/2010 | Chen | 126/337 R |
| 2012/0097147 | A1 * | 4/2012 | Steurer et al. | 126/339 |

* cited by examiner

*Primary Examiner* — Janet M Wilkens
(74) *Attorney, Agent, or Firm* — Dority & Manning, P.A.

(57) ABSTRACT

An appliance is provided having one or more racks or shelves, the position of which may be adjusted vertically. Multiple different positions along the vertical direction can be made available for selection by a user of the appliance. One or more mechanisms allow for the selective adjustment and securing of the vertical position at which a shelf may be located.

18 Claims, 12 Drawing Sheets

FIG. —1—

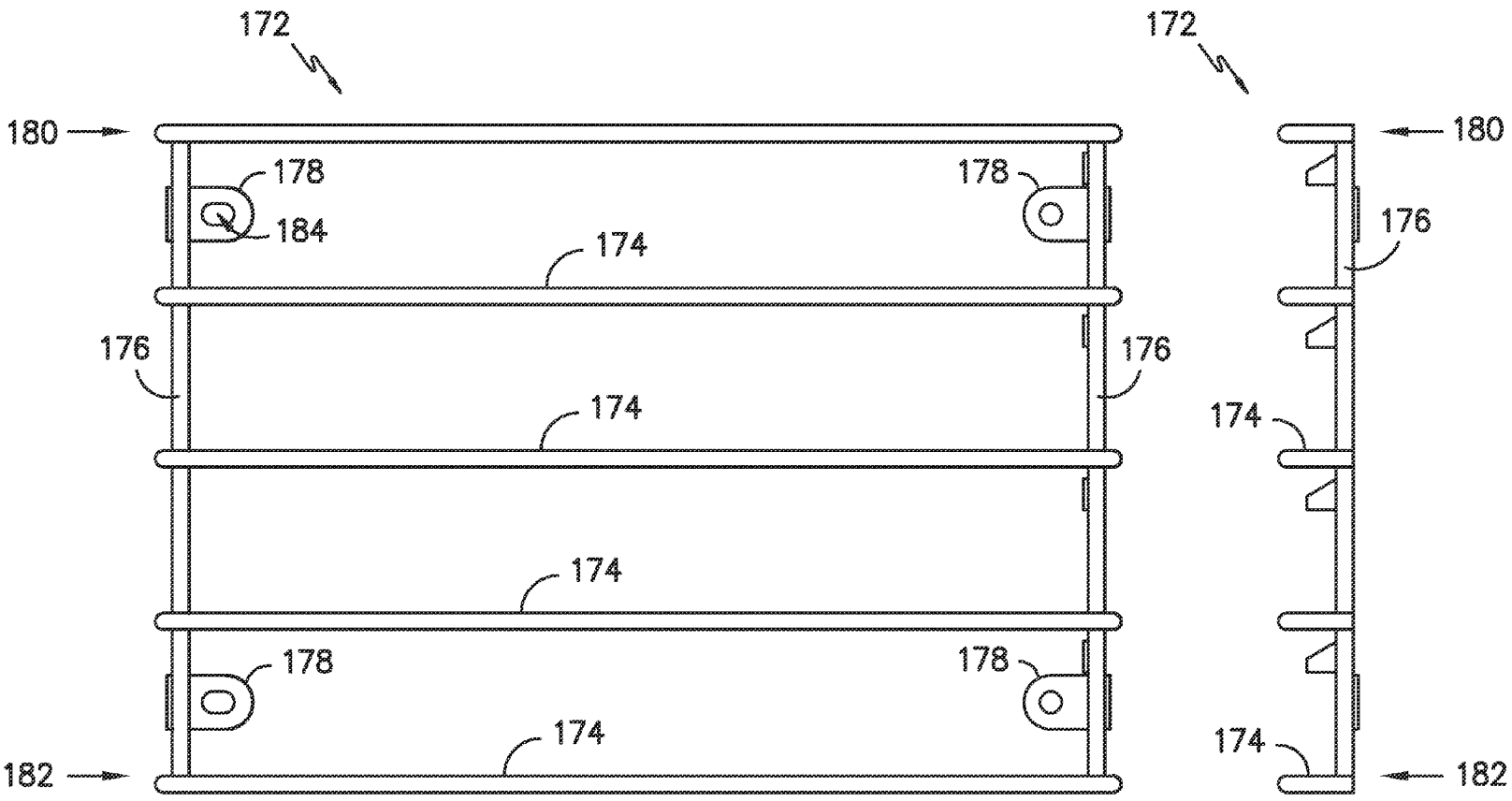
FIG. —4—
FIG. —3—

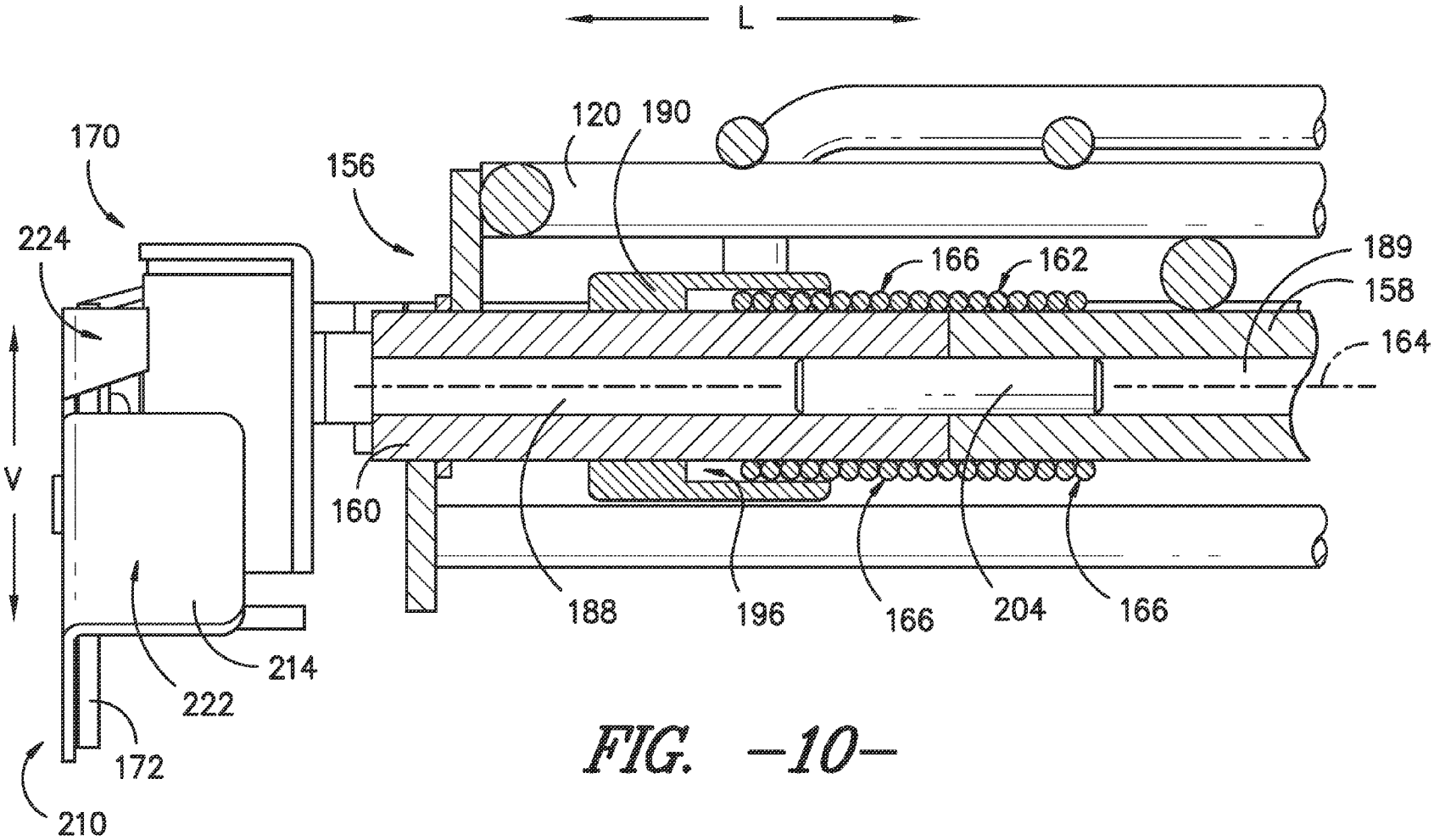
FIG. —10—

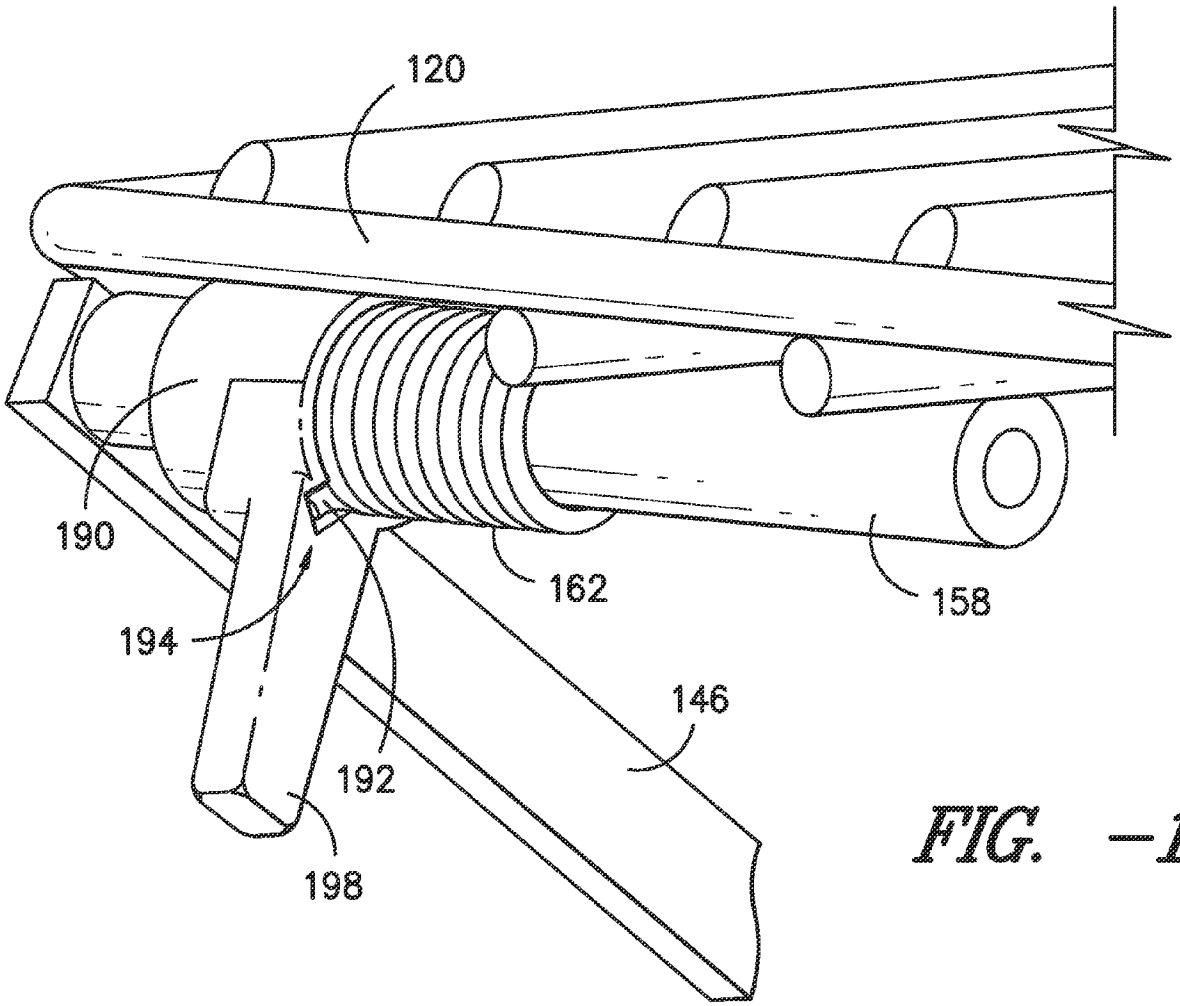
FIG. —11—

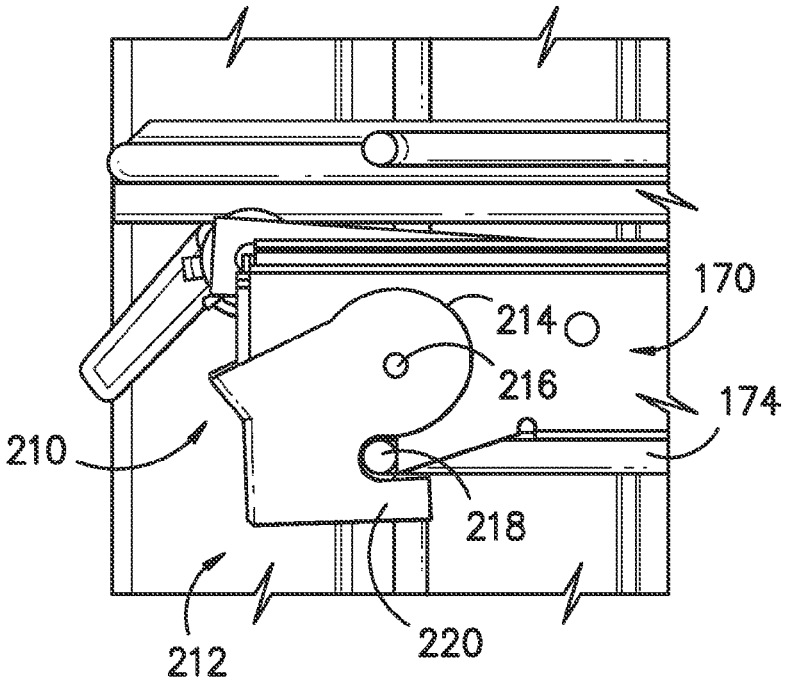
FIG. —12—
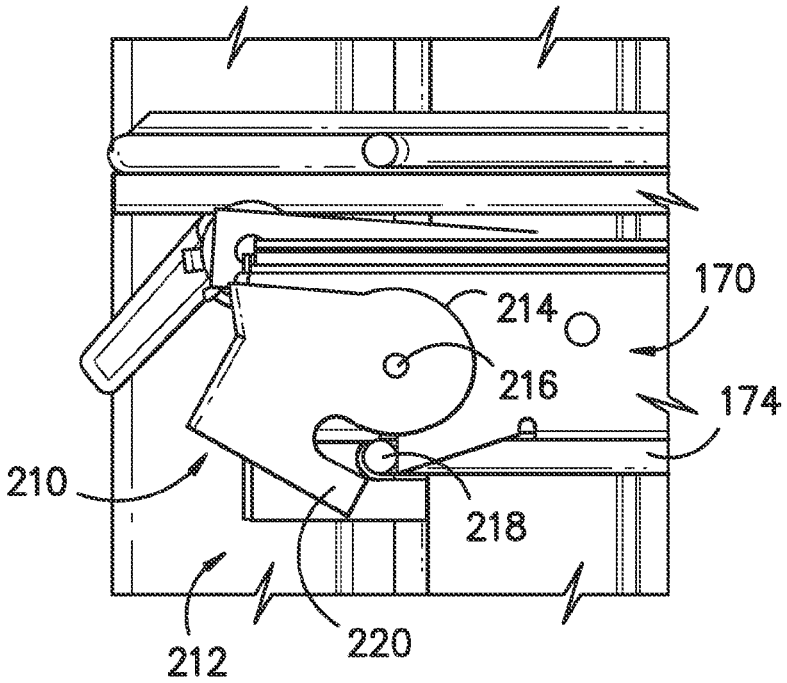
FIG. —13—

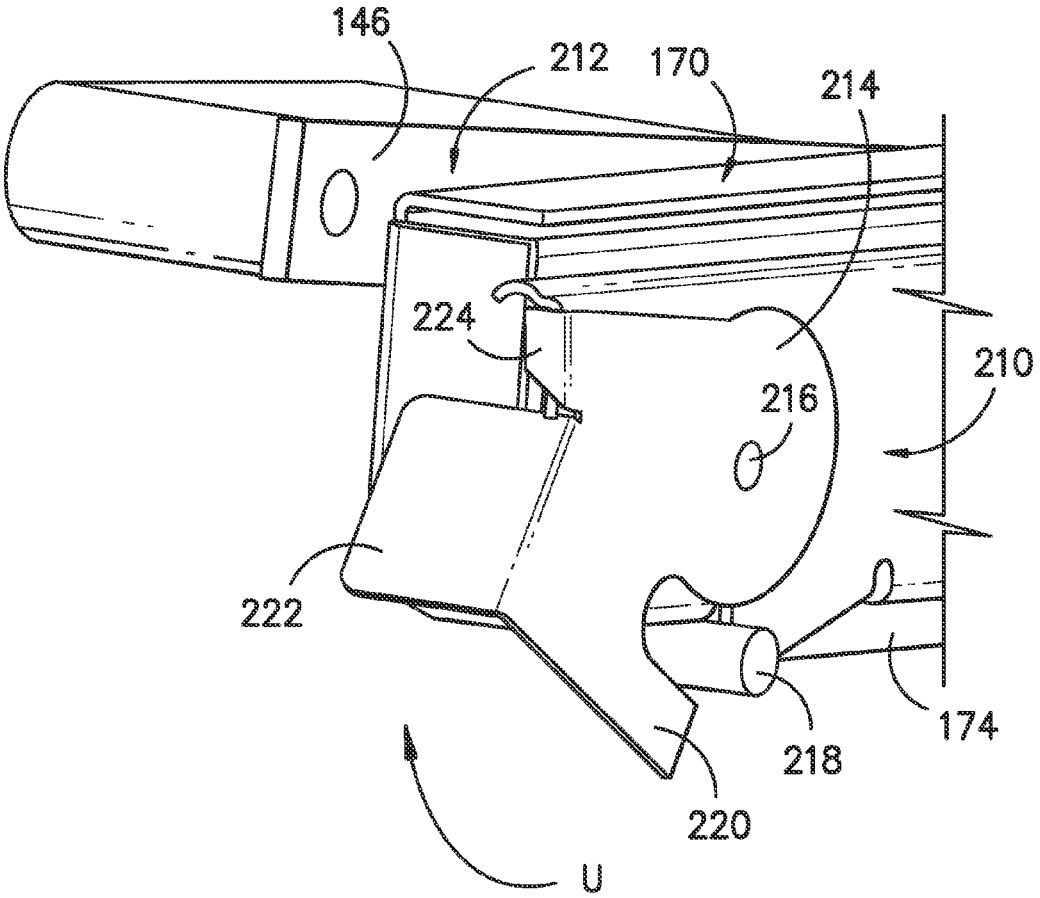
FIG. —14—

VERTICALLY ADJUSTABLE SHELF SUPPORT ASSEMBLY FOR AN APPLIANCE

FIELD OF THE INVENTION

The subject matter of the present disclosure relates to an appliance with one or more features providing for the adjustability and locking of the vertical position of a shelf or rack.

BACKGROUND OF THE INVENTION

Appliances such as refrigerators and ovens typically include one or more shelves or racks for the support of food items and containers having food items. For example, oven appliances conventionally include one or more racks whereby multiple food items can be placed into the oven for cooking operations. In order to accommodate food items and cooking utensils of different sizes, a typical construction includes horizontal protrusions formed directly into the side walls of the oven cavity on which the racks can be slid in and out of the oven cavity. The racks and protrusions are designed so that the user can remove the rack from the protrusions at one vertical level and reinstall the rack at a different vertical level, which the user may select based on e.g., the height of the food items or utensils, the number of items being cooked, the type of food being cooked, and/or other factors. Refrigerators may have shelves that e.g., include tabs or hooks at the rear of the shelves. The shelves can be unhooked and moved to another vertical location.

Such conventional designs may present challenges to some users of these appliances, however. For example, some users may find the removal and reinstallation of the rack or shelf so as to adjust the vertical height to be cumbersome or difficult. Additionally, with oven appliances, the protrusions are commonly formed by stamping metal sheets to form the side walls of the oven cavity. The number of vertical levels may be limited to e.g., only four or five within the oven cavity. Thus, the amount of vertical adjustability can be quite limited and, therefore, unsatisfactory to some users. Similar problems can exist with shelving systems in refrigerator appliances.

Other systems have been proposed to provide vertical adjustability for the racks or shelves within an appliance. Typically, however, these constructions are also limited to fixed number of a relatively few locations at which the racks or shelves can be placed within the appliance. Some constructions may also be limited in the amount of weight that can be supported.

Accordingly, an appliance having vertically adjustable racks or shelves would be useful. An appliance also having features that allow for an increased selection of vertical locations to which the racks or shelves can be adjusted would also be useful. An appliance having one or more features to secure the vertical position of the racks or shelves would also be useful.

BRIEF DESCRIPTION OF THE INVENTION

The present invention provides an appliance having one or more racks or shelves, the position of which may be adjusted vertically. Multiple different positions along the vertical direction can be made available for selection by a user of the appliance. One or more mechanisms allow for selective adjustment and securing of the vertical position at which a shelf may be located. Additional aspects and advantages of the invention will be set forth in part in the following description, or may be apparent from the description, or may be learned through practice of the invention.

In one exemplary embodiment, the present invention provides an adjustable shelf support assembly for an appliance. The appliance includes a pair of opposing side walls. The adjustable shelf support assembly includes a shelf having a pair of opposing sides for positioning near the opposing side walls. A latch receiver is positioned along one of the opposing side walls. A rotatable latch is positioned near a front portion of the shelf support assembly. The latch is rotatable within a plane that is parallel to the opposing side walls of the oven appliance. The latch is rotatable between i) a first position where the latch engages the latch receiver so as to fix the vertical position of a front portion of the shelf support assembly and ii) a second position where the latch is disengaged from the latch receiver such that the front portion of the shelf support assembly is movable vertically.

In another exemplary embodiment, the present invention provides an appliance having a vertically adjustable shelf assembly. The appliance includes a cabinet defining a cavity including a pair of opposing side walls and a rear wall. A shelf is positioned in the cavity. The shelf has a pair of opposing sides. A latch mechanism is provided that includes a pair of latches. Each latch is positioned along one of the opposing sides of the shelf, and each latch is pivotable between a first position where the latch secures a front portion of the shelf support assembly from vertical repositioning and a second position where the latch mechanism is disengaged so as to allow vertical repositioning of the shelf support assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 is a front view of an exemplary embodiment of a frame or ladder system as may be used to support one or more oven racks FIG. 4 is an end view of the exemplary frame of FIG. 1.

FIG. 9 is a close up and perspective view of one side the exemplary adjustable shelf assembly of FIGS. 5, 6, 7, and 8—while FIG. 10 is a partial cross-sectional view of the same side.

FIG. 11 is another close up and perspective view of the same side albeit from a different angle of view.

FIG. 12 is a side view of an exemplary locking mechanism of the present invention shown in a first position.

FIG. 13 is a side view of the exemplary locking mechanism of FIG. 12 shown in a second position.

FIG. 14 is a perspective view of the exemplary locking mechanism of FIG. 12 shown in a second position.

DETAILED DESCRIPTION OF THE INVENTION

Figure 1:
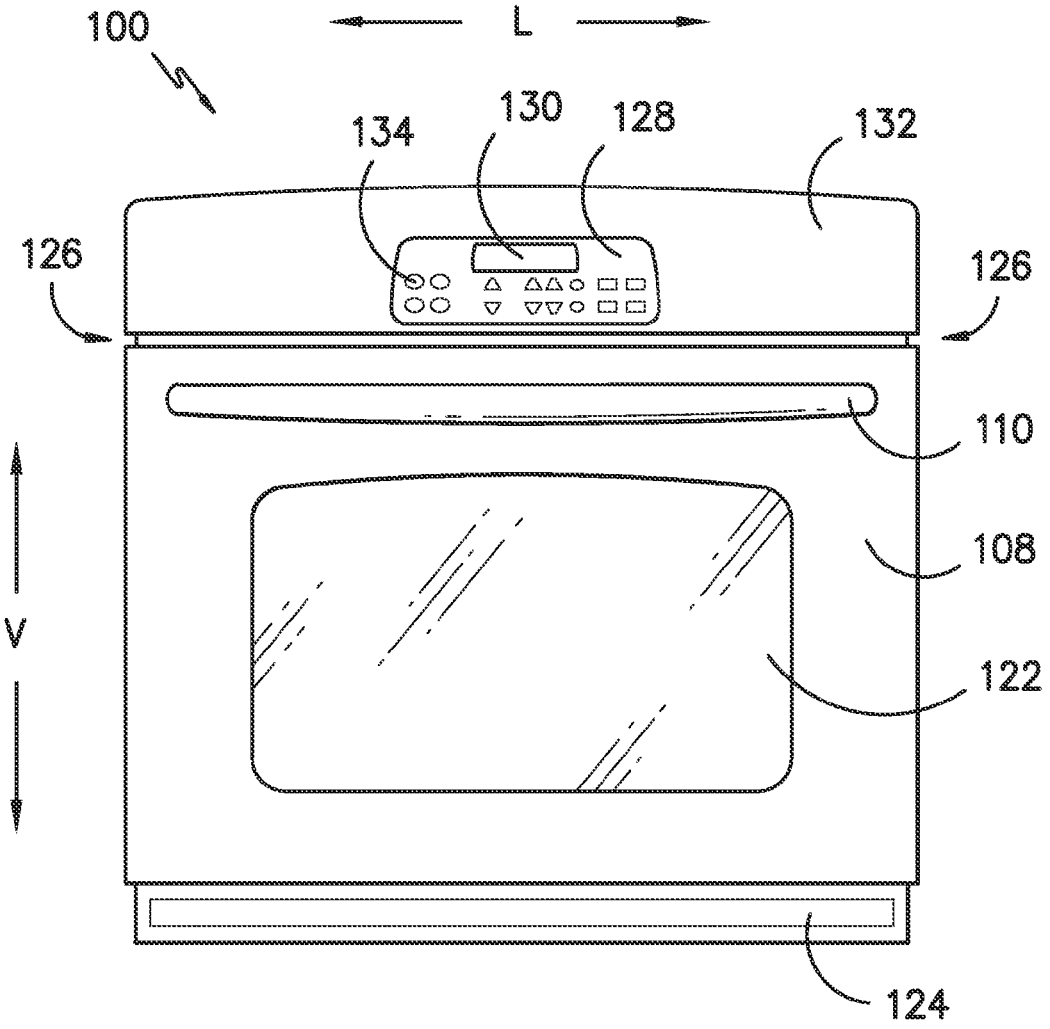
FIG. 1 is a front view of an exemplary embodiment of an oven appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
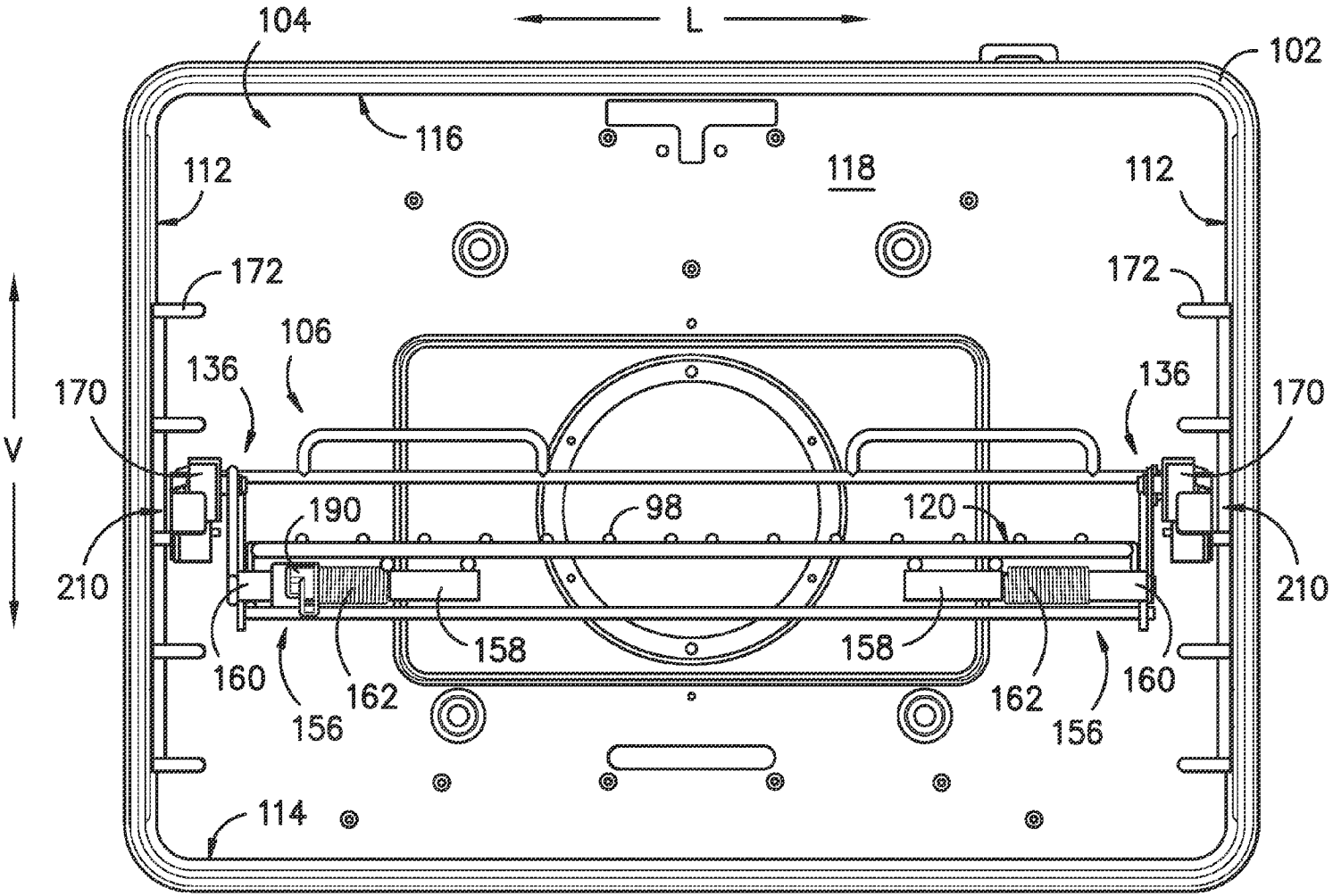
FIG. 2 is a front view of an exemplary oven cabinet and oven cavity of the present invention as may be used in the exemplary appliance of FIG. 1.
Figure 5:
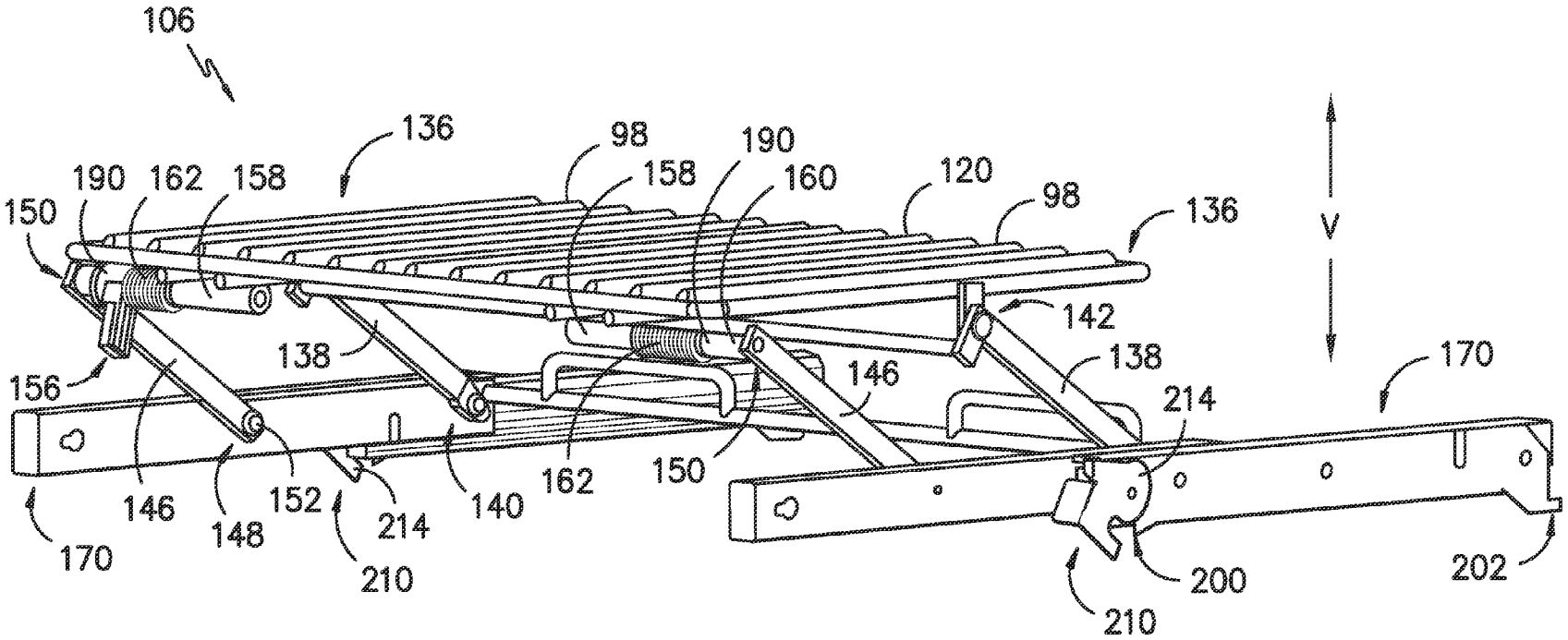
FIG. 5 is a perspective view of an exemplary embodiment of an adjustable shelf assembly for an appliance.

Referring to FIG. 1, an exemplary embodiment of an oven 100 according to the present invention is shown. FIG. 1 provides a front view of oven 100 while FIG. 2 provides a front view into the cabinet 102 of oven 100, which defines an exemplary cooking chamber or cavity 104 into which a vertically adjustable shelf (or rack) support assembly 106 has been installed. As used herein, "rack" is not limited to an assembly of elongated wire structures 98 (e.g., FIG. 5) and includes shelves constructed from other materials such as expanded metal and others. Accordingly, "rack" and "shelf" (and the plural forms thereof) are used interchangeably herein. Also, as will be understood by one of skill in the art using the teachings disclosed herein, support assembly 106 can be used with shelves or racks in other appliances such as e.g., refrigerators as well. As such, oven 100 is provided by way of example of an appliance only.

Oven 100 includes a door 108 with handle 110 that provides for opening and closing access to oven cavity 104 through an opening at the front of cavity 104. A user of the appliance 100 can place a variety of different items to be cooked in oven cavity 104, which is defined a pair of opposing side walls 112, bottom wall 114, top wall 116, and rear wall 118 that extends laterally between opposing side walls 112. Multiple oven shelves or racks 120 can be positioned within cavity 104 (only one shelf 120 is shown) on rack support assembly 106. The support and height adjustability of shelf 120 using assembly 106 will be further described.

One or more heating elements (not shown) can be positioned e.g., at the top 116 of chamber 104 to provide heat for cooking and cleaning. Such heating element(s) can be e.g., gas, electric, microwave, or a combination thereof. Other heating elements can be located at the bottom 114 of chamber 104 as well. A window 122 on door 108 allows the user to view e.g., food items during the cooking process. For purposes of cooling, inlet 124 allows for an inflow of ambient air into a ventilation system while vent 126 allows for the outflow of such air after it has been heated by oven 100.

Oven 100 includes a user interface 128 having a display 130 positioned on top panel 132 with a variety of controls 134. Interface 128 allows the user to select various options for the operation of oven 100 including e.g., temperature, time, and/or various cooking and cleaning cycles. Operation of oven appliance 100 can be regulated by a controller (not shown) that is operatively coupled i.e., in communication with, user interface panel 128, heating element(s), and other components of oven 100 as will be further described.

For example, in response to user manipulation of the user interface panel 128, the controller can operate one or more heating element(s). The controller can receive measurements from a temperature sensor (not shown) placed in oven cavity 104 to e.g., provide a temperature indication to the user with display 130. By way of example, the controller may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout appliance 100. In the illustrated embodiment, the controller may be located under or next to the user interface 128 or otherwise within top panel 132. In such an embodiment, input/output ("I/O") signals are routed between the controller and various operational components of appliance 100 such as heating element(s), controls 134, display 130, sensor(s), alarms, and/or other components as may be provided. In one embodiment, the user interface panel 128 may represent a general purpose I/O ("GPIO") device or functional block.

Although shown with touch type controls 134, it should be understood that controls 134 and the configuration of appliance 100 shown in FIG. 1 is provided by way of example only. More specifically, user interface 128 may include various input components, such as one or more of a variety of electrical, mechanical or electro-mechanical input devices including rotary dials, push buttons, and touch pads. The user interface 128 may include other display components, such as a digital or analog display device designed to provide operational feedback to a user. The user interface 128 may be in communication with the controller via one or more signal lines or shared communication busses. Also, oven 100 is shown as a wall oven but the present invention could also be used with other appliances such as e.g., a stand-alone oven, an oven with a stove-top, and non-oven appliances as well. For example, the adjustable shelf support assembly 106 could also be used within a refrigerator appliance.

FIG. 2 illustrates adjustable shelf support assembly 106 supported upon a pair of frames 172, where each frame 172 is mounted on one of the opposing side walls 112 of the cabinet 102. Referring now to FIGS. 3 and 4, front views and end views are provided of an exemplary embodiment of frame 172 as may be used to support one or more oven adjustable shelf support assemblies 106. Frame 172 includes a plurality of horizontal supports 174 that extend from vertical supports 176. Horizontal supports 174 extend away from vertical supports 176 and into oven cavity 104. Each vertical support 176 has two tabs 178, one each positioned near the top 180 and bottom 182 of vertical support 176. Tabs 178 each include an aperture 184 (FIG. 3) for attachment using a fastener to a respective side wall 112 of oven 100.

For this exemplary embodiment, a pair of frames 172 is mounted within cavity 104—one each along the opposing side walls 112. Horizontal supports 174 can be used to provide support for one or more shelf support assemblies 106. For the exemplary embodiment shown in the figures, up to five different vertical levels are provided for placement of one or more assemblies 106. The levels are provided by the pairs of opposing horizontal supports 174—one each extending from a frame 172 positioned on opposing sides walls 112.

Frame 172 is provided by way of example, and other configurations may be used as well. For example, a different number of horizontal supports 174 may be employed for more or less racks as desired. Frame 172 can be constructed from elongated wire members that are welded together as shown. One or more coatings may also be applied to protect frame 172 from the extreme temperature conditions that can be encountered in oven 100. Other materials may also be used to construct frame 172. In addition, shelf support assembly 106 could be supported on other structures other than frames 172, and/or could be mounted directly onto opposing side walls 112.

Referring again now to FIGS. 2 and 7, shelf support assembly 106 includes a shelf 120 having a front portion 186, a rear portion 206, and a pair of opposing sides 136 that are positioned proximate to opposing side walls 112 when shelf assembly 106 is not extended out of cavity 104 on slide assemblies 170. As shown in FIGS. 2, 5, 6, and 7, a plurality of support legs 138 extend from the opposing sides 136 of shelf 120. More particularly, for this exemplary embodiment, assembly 106 include a pair of support legs 138, one each extending from each side 136 of assembly 106. Each support leg 138 has a first end 142 and a second end 140. First end 142 of each support leg 138 is rotatably connected to one of the opposing sides 136 of shelf 120. As such, the first end 142 of each support leg 138 can rotate or pivot relative to shelf 120 within a vertical plane.

The second end 140 of each support leg 138 is configured for rotatable support or connection along one of the opposing side walls 112 so that the second end 140 of each support leg 138 can rotate or pivot relative to opposing side walls 112 of cabinet 102 within a vertical plane. For this exemplary embodiment, second end 140 of each support leg 138 is rotatably connected to one of the slide assemblies 170, the function of which will be further described. However, in other exemplary embodiments of the invention, the second end 140 of each support leg 138 can be rotatably connected to one of the opposing side walls 112. Other constructions for connecting second end 140 may be used as well.

While only a pair of support legs 138 are illustrated in the exemplary embodiment of the figures, it should be understood that other configurations may be used as well. For example, three, four, or even more support legs 138 could be used depending upon e.g., the anticipated weight to be supported by shelf 120, the number of locking legs 146 (further described below) that are employed, and other factors.

Continuing with FIGS. 2, 5, 6, and 7, shelf support assembly 106 also includes a pair of locking legs 146 connected to the opposing sides 136 of shelf 120. Each locking leg 146 includes a first end 150 and a second end 148. The second end 148 of each locking leg 146 is configured for rotatable support or connection along one of the opposing side walls 112 so that the second end 148 of each locking leg 146 can rotate or pivot relative to opposing side walls 112 of cabinet 102. For this exemplary embodiment, second end 148 of each locking leg 146 is rotatably connected to one of the slide assemblies 170, the function of which will be further described. However, in other exemplary embodiments of the invention, the second end 148 of each locking leg 146 can be rotatably connected to one of the opposing side walls 112. As with support legs 138, other constructions may be used as well.

Figure 7:
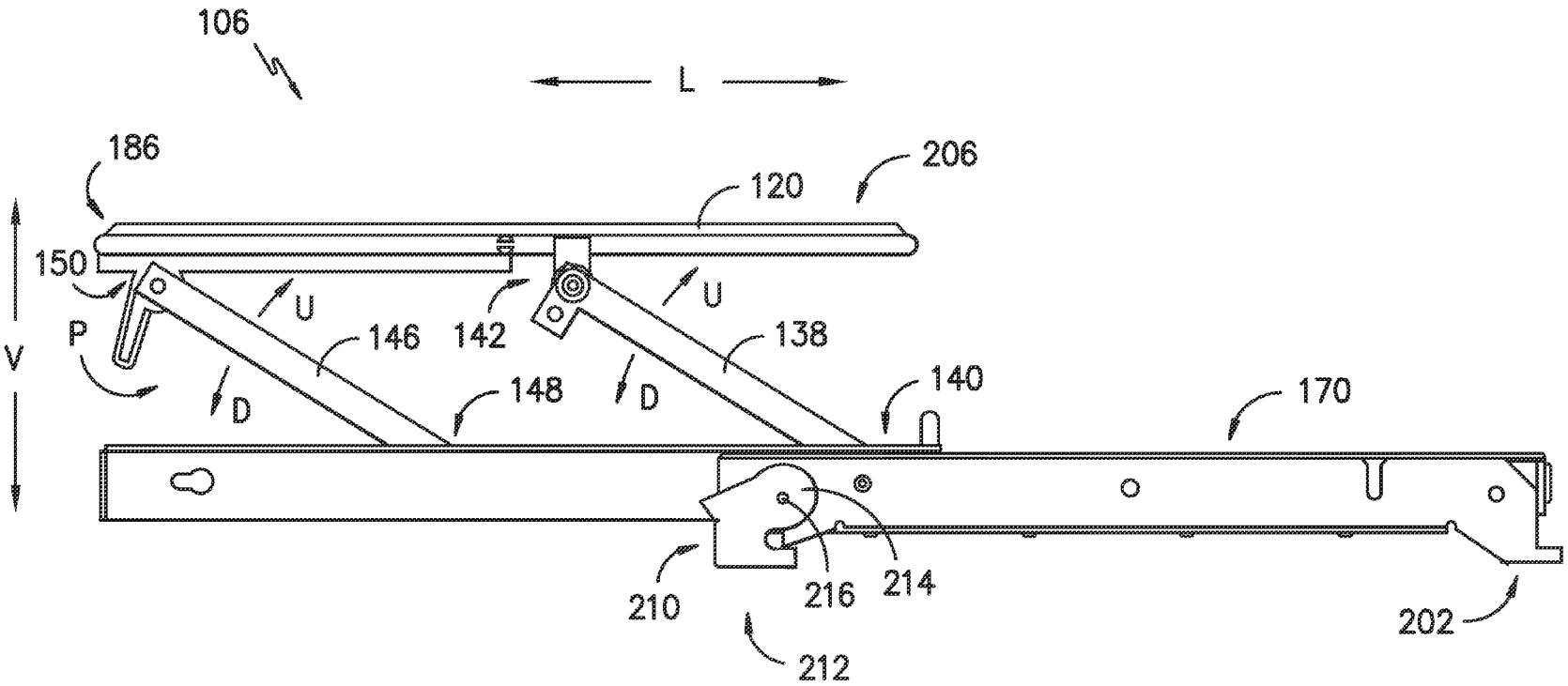
FIG. 7 provides a side view of the exemplary adjustable shelf assembly of FIGS. 5 and 6.
Figure 8:
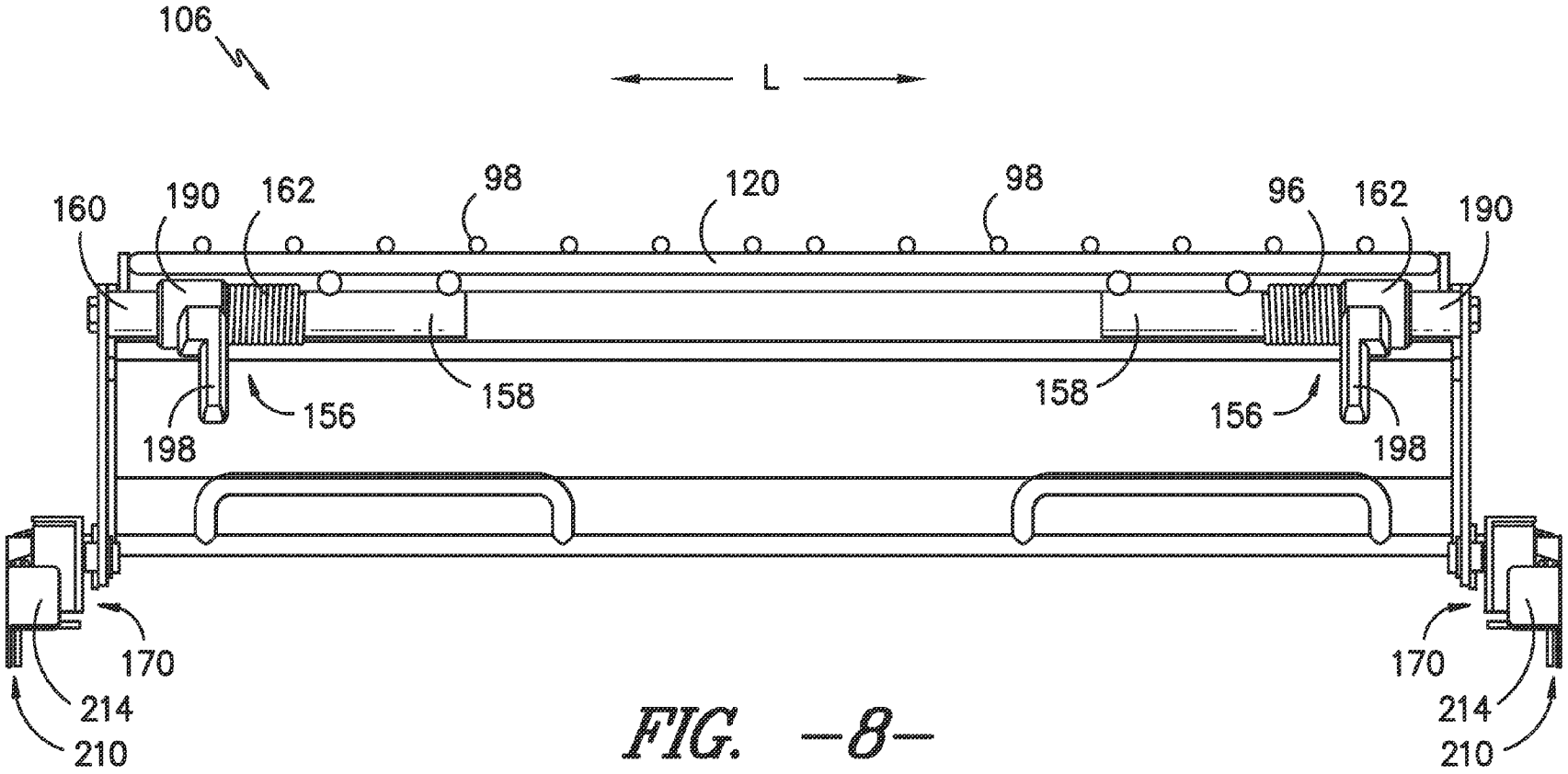
FIG. 8 is a front view of the exemplary adjustable shelf assembly of FIGS. 5, 6, and 7.
Figure 9:
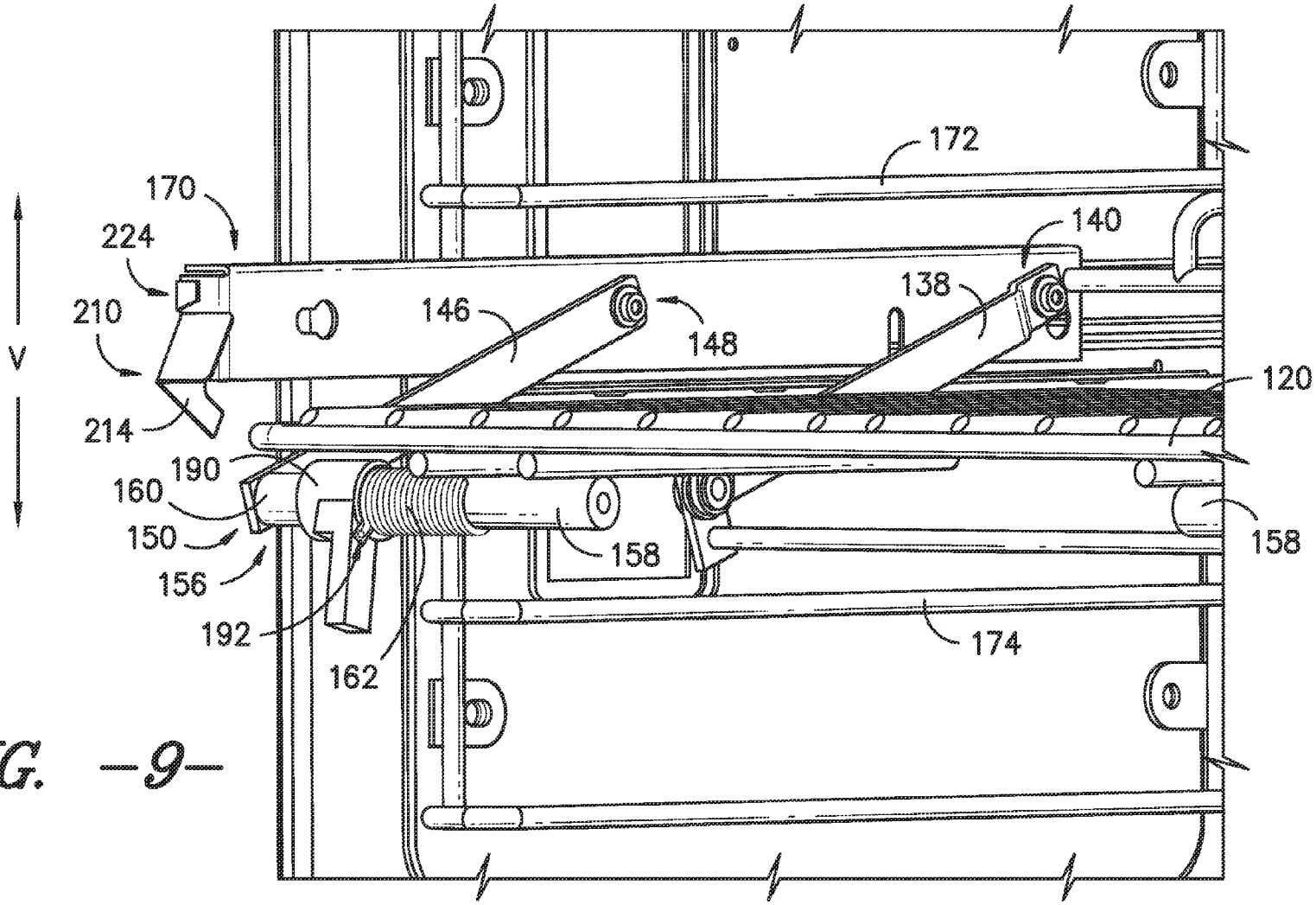

The first end 150 of each locking leg 146 is connected with a locking mechanism 156, a pair of which are positioned at the front 186 of shelf 120 along opposing sides 136. Locking mechanism 156 is configured for fixing the position of shelf 120 along vertical direction V. For this exemplary embodiment, each locking mechanism 156 includes a first shaft 158 that is connected to shelf 120 near one of the opposing sides 136 and front 186 (FIG. 7). First shaft 158 extends along lateral direction L and is constructed with a substantially cylindrical shape. By way of example, first shaft 158 is welded or otherwise attached to shelf 120 so that first shaft 158 is not rotatable relative to shelf 120.

Each locking mechanism 156 also includes a second shaft 160 that extends along lateral direction L and is connected to the first end 150 of locking leg 146. By way of example, second shaft 160 is welded or otherwise attached to locking leg 146 so that second shaft 160 is not rotatable relative to locking leg 146. Second shaft 160 is also constructed with a substantially cylindrical shape.

Figure 6:
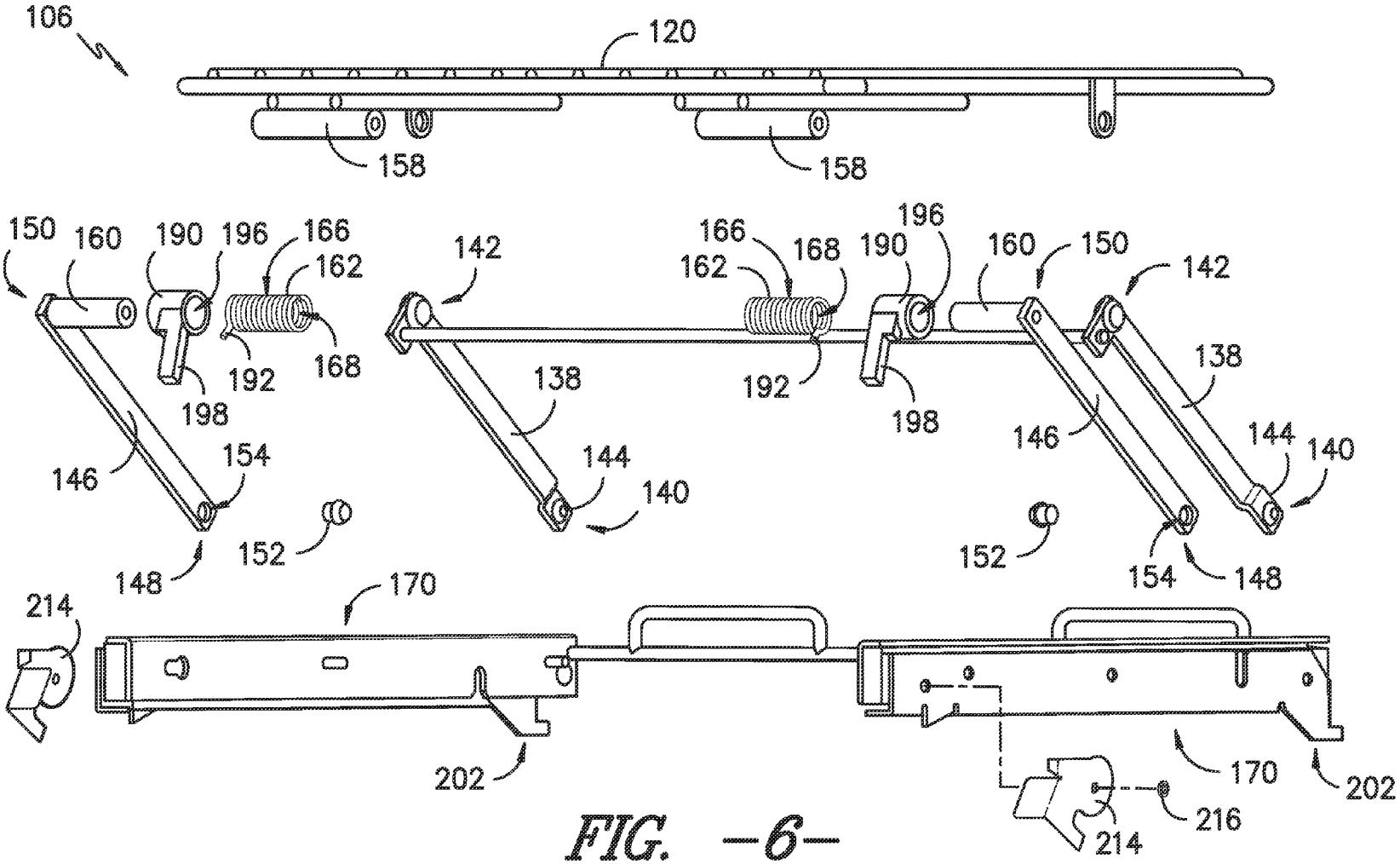
FIG. 6 is an exploded view of an exemplary embodiment of the adjustable shelf assembly of FIG. 5.

Referring now to FIG. 6 and the cross-sectional view shown in FIG. 10, each locking mechanism 156 includes a spring 162 that defines a spring axis 164 encircled by spring coils 166. Spring 162 defines a cavity 168 into which at least a portion of first shaft 158 as well as second shaft 160 are received. More specifically, spring 162 is wrapped around a portion of first shaft 158 and a portion of second shaft 160 to create an interference fit therebetween. For this exemplary embodiment, first shaft 158 and second shaft 160 define a first shaft channel 188 and second shaft channel 189, respectively, into which a pin 204 or other feature can be provided so as to maintain the alignment between shafts 158 and 160 while still allowing each to slightly rotate relative to each other as shelf 120 is raised or lowered along vertical direction V.

The spring coils 166 of each spring 162 are wrapped around shafts 158 and 160 so that as shelf 120 is raised along vertical direction V, the tension in springs 162 is decreased and shafts 158 and 160 can rotate slightly relative to each other while remaining aligned along spring axis 164. The rotation of second shaft 160 relative to first shaft 158 allows locking legs 146 and support legs 138 to rotate or pivot (arrow U in FIG. 7) within a vertical plane so that shelf 120 can be raised to the height desired.

Conversely, the wrapping of spring coils 166 of each spring also results in an increase in spring tension when shelf 120 is lowered along vertical direction V. More specifically, as shelf 120 is lowered, second shaft 160 will rotate slightly relative to first shaft 158. However, because of the wrapping of spring coils 166 about shafts 158 and 160 and/or the interference fit between springs 162 and the first and second shafts 158 and 160, the rotation of second shaft 160 as shelf 120 is lowered will increase the tension in springs 162. This increase in tension will cause springs 162 to further constrict or grip shafts 158 and 160 along each side of shelf 120. As such, the rotation of second shaft 160 will eventually be precluded—thereby locking the position of shelf 120 along vertical direction V because support legs 138 and locking legs 146 will be precluded from moving or pivoting within a vertical plane along the direction of arrow D. Increasing a downward force on shelf 120 (e.g., by placing additional food items on shelf 120) only further increases the tension in springs 162 so as to maintain shelf 120 at a specific vertical position.

Each locking mechanism 162 also includes a control hub 190 carried on one or both of the first and second shafts 158 and 160. More particularly, as shown in FIGS. 7, 8, 9, 10, and 11, each control hub 190 includes an opening or chamber 196 with a notch or slot 194 positioned adjacent to the chamber 196. A tang 192 projects radially outward from coils 166 of each spring 162 and is received into slot 164 of control hub 190.

Once springs 162 have locked the vertical position of shelf 120, the tension in springs 162 must be released to further lower shelf 120 along the vertical direction. Accordingly, by rotating control hubs 190, the tension in springs 162 can be released. For example, for this exemplary embodiment, the user can depress the handles 198 on control hubs 190 so as to rotate hubs 190 along the direction shown by arrow P in FIG. 7. This movement releases the tension in spring 162, allowing second shaft 160 to rotate relative to first shaft 158, thereby allowing locking legs 148 and support legs 138 to pivot downward within a vertical plane as shown by arrow D in FIG. 7. Once the desired vertical position is reached, the user can release control hubs 190, which allows the tension in springs 162 to increase due to the descent of shelf 120. Eventually this tension will increase to an amount that prevents further rotation of second shaft 160 relative to first shaft 158, thereby preventing any further downward movement of shelf 120 along vertical direction V.

Thus, locking mechanism 156 allows a user to selectively adjust shelf 120 to multiple different vertical levels and, therefore, is not limited to a predetermined number of vertical positions as with certain conventional constructions. In addition, the use of frames 172 with horizontal supports 174 also provides increased adjustability along the vertical direction as well as allowing for the receipt of multiple shelves 120, each of which can be equipped with an adjustable shelf support assembly 106.

While the exemplary embodiment in the figures illustrates the use of a pair of locking legs 146 and locking mechanisms 156, a single locking mechanism and locking leg along one side 136 of shelf 120 may be used as well. For example, one of the locking legs 146 and locking mechanisms 156 shown in the figures could be replaced with a support leg 138 such that shelf 120 is supported by three support legs 138 and one locking leg 146. Other constructions may be used as well.

The construction of slide assemblies 170 facilitates the insertion, extension, and removal of shelf 120 from cavity 104. For example, slides 170 can be configured with one or more ball bearings to reduce friction from sliding movement. Slides 170 can also allow for a full extension of rack 120 from cavity 104 for more complete access to food and/or utensils placed on rack 132. Tab 200 prevents slide assemblies 170 from sliding out of cavity 104 during use while finger 202 prevents tipping when slides 170 are fully extended. Other constructions facilitating the movement of shelf 120 along transverse direction T in and out of oven cavity 104 may be used as well.

Referring again to FIG. 2, as stated above, the use of frames 172 with horizontal supports 174 provides increased adjustability along vertical direction V because the adjustable shelf support assembly 106 can be removed from one pair of horizontal supports 174 and repositioned at another pair of horizontal supports 174. In one exemplary embodiment of the present invention, adjustable shelf support assembly 106 is provided with a latch mechanism 210 that can be used to help secure the vertical position of shelf support assembly 106 once it is located on a pair of supports 174.

More particularly, in this exemplary embodiment, latch mechanism 210 includes a pair of rotatable latches 214. Each latch 214 is positioned along one of the opposing sides 136 of shelf 120 near the front portion 212 (FIGS. 2 and 7) of shelf support assembly 106. Each latch 214 is rotatable or pivotable within a plane that is parallel to the opposing side walls 112 of oven 100.

As best seen in FIGS. 12, 13, and 14, a fastener such as a pin or rivet 216 attaches each latch 214 to a respective slide assembly 170 and forms a point about which latch 214 is rotatable. Other constructions for allowing latch 214 to rotate may be used as well. Each latch 214 is rotatable between a first position as shown in FIG. 12 and a second position as shown in FIG. 13.

In the first position depicted in FIG. 12, latch 214 engages a latch receiver 218 positioned along one of the opposing side walls 112 of oven cavity 104. For this exemplary embodiment, a portion of one of the horizontal supports 174 functions as the latch receiver 218. In other exemplary embodiments of the invention, other constructions such as e.g., a pin or shaft extending from side wall 112 may be used with latch receiver 218. Each latch 214 includes a hook 220 for engaging the latch receiver 218/horizontal support 174. When hook 220 is engaged as shown in FIG. 12, the front portion of shelf support assembly 106 is secured or fixed at a particular vertical position. As a result, when user e.g., attempts to raise shelf 120 by depressing handles 198 and lifting shelf 120 as previously described, latches 214 engage latch receiver 218/horizontal support 174 to keep slides assemblies 170 in position as shelf 120 is raised.

In the second position depicted in FIG. 13, latch 214 is disengaged from latch receiver 218/horizontal support 174. In this second position, the front portion 212 of shelf support assembly 106 is movable vertically and therefore may be repositioned. More particularly, each latch 214 includes a latch handle 222 a user may use to rotate latch 214 upward as indicated by arrow U in FIG. 14. This rotation disengages hook 220 from latch receiver 218/horizontal support 174. A stop 224 limits the amount of rotation of latch 214.

With each latch 214 rotated upward, a user can relocate shelf support assembly 106 to another pair horizontal supports 174 at a different vertical level or remove assembly 106 for cleaning. Once shelf support assembly 106 is repositioned onto a pair of horizontal supports 174, each latch 214 is released and can fall back into the first position so that each hook 220 engages with a respective receiver 218/horizontal support 174. If desired, a spring or other mechanism can be used to bias latch 214 towards the first position. The particular shape of latch 214 including hook 220 is provided by way of example only. Other shapes may be used as well.

As will be understood by one of ordinary skill in the art using the teachings disclosed herein, latch mechanism 210 is not limited to use with the particular exemplary embodiment of an adjustable shelf support assembly 106 shown in the figures. Instead, latch mechanism 212 may be used with a variety of other vertically adjustable shelf support assemblies or mechanisms that provide for the vertical adjustability of shelf 120. As such, latch mechanism 212 (and other exemplary embodiments thereof) provides for securing such assembly into place so that shelf 120 may be raised or lowered without unintentionally moving the entire shelf support assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An adjustable shelf support assembly for an appliance, the appliance including a pair of opposing side walls, the adjustable shelf support assembly comprising:

a shelf having a pair of opposing sides for positioning near the opposing side walls;

a latch receiver for positioning along one of the opposing side walls;

a rotatable latch positioned near a front portion of the shelf support assembly, the latch rotatable within plane that is parallel to the opposing side walls of the oven appliance, the latch rotatable between i) a first position where the latch engages the latch receiver so as to fix the vertical position of a front portion of the shelf support assembly and ii) a second position where the latch is disengaged from the latch receiver such that the front portion of the shelf support assembly is movable vertically; and a plurality of support legs extending from the opposing sides of the shelf, each leg having a first end and a second end, wherein the first end is rotatably connected to one of the opposing sides of the shelf, and wherein the second end of each support leg is configured for rotatable connection along one of the opposing side walls of the appliance;

at least one locking leg connected to one of the opposing sides of the shelf, the locking leg having a first end and a second end, wherein the second end of the at least one locking leg is configured for rotatable connection along one of the opposing side walls of the appliance;

a locking mechanism for fixing the vertical position of the shelf, the locking mechanism comprising;

a first shaft connected with the shelf and extending along a lateral direction;

a second shaft connected with the first end of the at least one locking leg, wherein the first and second shafts are rotatable relative to each as the shelf is raised or lowered; and a spring defining a spring axis and coils encircling the spring axis to create a cavity into which at least parts of the first shaft and the second shaft are received, the spring wrapped around the first shaft and the second shaft in a manner that increases the tension on the spring as the shelf is lowered and decreases the tension on the spring as the shelf is raised.

2. An adjustable shelf support assembly for an appliance as in claim 1, wherein the latch further comprises a hook for engaging the latch receiver.

3. An adjustable shelf support assembly for an appliance as in claim 2, wherein the latch further comprises a handle whereby user can rotate the latch to release the front portion of the shelf support assembly so that the vertical position of the shelf can be adjusted.

4. An adjustable shelf support assembly for an appliance as in claim 1, wherein the second end of each support leg is rotatably connected to one of the opposing sidewalls of the appliance, and wherein the second end of the at least one locking leg is also rotatably connected to one of the opposing side walls of the appliance.

5. An adjustable shelf support assembly for an appliance as in claim 1, further comprising:

a pair of slide assemblies, each slide assembly positioned along one of the opposing side walls and extendable from the appliance; and wherein the second end of each support leg is rotatably attached to one of the slide assemblies, the second end of the at least one locking leg is rotatably attached to one of the slide assemblies, and the latch is rotatably attached to one of the slide assemblies.

6. An adjustable shelf support assembly for an appliance as in claim 5, further comprising a pair of frames, each frame configured for mounting in opposing fashion on the opposing side walls of the appliance, each frame having a plurality of horizontal supports extending between a pair of vertical supports, wherein the pair of slide assemblies are each supported upon the pair of frames.

7. An adjustable shelf support assembly for an appliance as in claim 6, wherein the latch receiver comprises at least one of the horizontal supports of the pair of frames.

8. An adjustable shelf support assembly for an appliance as in claim 1, wherein the locking mechanism further comprises a control hub carried on one or both of the first shaft and second shaft, and wherein the control hub is connected to the spring and is configured for selectively releasing the tension in the spring.

9. An adjustable shelf support assembly for an appliance as in claim 8, wherein the control hub defines a chamber into which one or both of the first shaft and second shafts are rotatably received, and wherein the spring further comprises a tang received by the control hub such that the control hub can be selectively rotated to release tension in the spring.

10. An adjustable shelf support assembly for an appliance as in claim 1, wherein the first shaft defines a first shaft channel and the second shaft defines a second shaft channel.

11. An appliance comprising:

a cabinet defining a cavity including a pair of opposing side walls and a rear wall;

a vertically adjustable shelf support assembly, comprising a shelf positioned in the cavity, the shelf having a pair of opposing sides;

a latch mechanism comprising;

a pair of latches, each latch positioned along one of the opposing sides of the shelf, each latch pivotable between a first position where the latch secures a front portion of the shelf support assembly from vertical repositioning and a second position where the latch mechanism is disengaged so as to allow vertical repositioning of the shelf support assembly;

at least two support legs rotatably connected along opposing sides of the shelf, each support leg also pivotally supported by the cabinet;

at least one locking leg connected to the shelf, the at least one locking leg having a first end and a second end, wherein the second end of the at least one locking leg is pivotally supported by the cabinet;

a first shaft connected with the shelf and extending along a lateral direction;

a second shaft connected with the first end of the at least one locking leg, wherein the first and second shafts are rotatable relative to each other as the shelf is raised or lowered; and a spring having coils wrapped around the first shaft and second shaft, the spring configured to increase in tension as the shelf is lowered along a vertical direction so as to limit the movement of the shelf and configured to decrease in tension as the shelf is raised along the vertical direction.

12. An appliance as in claim 11, wherein the second end of each support leg is pivotally connected with one of the opposing sidewalls of the appliance, and wherein the second end of the at least one locking leg is also pivotally connected with one of the opposing side walls of the appliance.

13. An appliance as in claim 11, further comprising a pair of slide assemblies, each slide assembly positioned along one of the opposing side walls and extendable from the appliance, wherein the second end of each support leg is pivotally connected with one of the slide assemblies, and wherein the second end of the at least one locking leg is rotatably attached to one of the slide assemblies.

14. An appliance as in claim 13, further comprising a pair of frames, each frame configured for mounting in opposing fashion on the opposing side walls of the appliance, each frame having a plurality of horizontal supports extending between a pair of vertical supports, wherein the pair of slide assemblies are each supported upon the pair of frames.

15. An appliance as in claim 14, wherein each latch of the pair of latches is pivotally attached to one of the slide assemblies.

16. An appliance as in claim 15, wherein each latch of the pair of latches comprises a hook.

17. An appliance as in claim 16, wherein the hook of each latch engages with one of the horizontal supports when the latch is in the first position.

18. An appliance as in claim 17, further comprising a control hub carried on one or both of the first shaft and second shaft, and wherein the control hub is connected to the spring and is configured for selectively releasing the tension in the spring.

* * * * *